US009611727B2

(12) United States Patent
Campbell et al.

(10) Patent No.: US 9,611,727 B2
(45) Date of Patent: Apr. 4, 2017

(54) APPARATUS AND METHOD FOR FRACTURING A WELL

(75) Inventors: Sean Patrick Campbell, Airdrie (CA); William Jani, Airdrie (CA)

(73) Assignee: Gryphon Oilfield Solutions, LLC, Houston, TX (US)

( * ) Notice: Subject to any disclaimer, the term of this patent is extended or adjusted under 35 U.S.C. 154(b) by 890 days.

(21) Appl. No.: 13/643,977

(22) PCT Filed: Apr. 28, 2011

(86) PCT No.: PCT/CA2011/000495
§ 371 (c)(1),
(2), (4) Date: Mar. 22, 2013

(87) PCT Pub. No.: WO2011/134069
PCT Pub. Date: Nov. 3, 2011

(65) Prior Publication Data
US 2013/0168098 A1 Jul. 4, 2013

(51) Int. Cl.
*E21B 43/26* (2006.01)
*E21B 34/14* (2006.01)

(52) U.S. Cl.
CPC ..... *E21B 43/26* (2013.01); *E21B 34/14* (2013.01)

(58) Field of Classification Search
CPC .... E21B 43/26; E21B 34/14; E21B 2034/007; E21B 43/267; E21B 33/12; E21B 34/06; E21B 17/20
USPC ..... 166/194
See application file for complete search history.

(56) References Cited

U.S. PATENT DOCUMENTS

| | | | | |
|---|---|---|---|---|
| 2,797,821 | A | 7/1957 | Blattner | |
| 3,247,905 | A * | 4/1966 | Baker | E21B 33/14 166/194 |
| 7,926,580 | B1 | 4/2011 | Darnell et al. | |
| 8,496,051 | B2 * | 7/2013 | Cejero | E21B 21/103 166/289 |
| 2006/0124310 | A1 * | 6/2006 | Lopez de Cardenas | E21B 34/06 166/313 |
| 2009/0266659 | A1 * | 10/2009 | Lembcke | E21B 34/14 188/268 |

(Continued)

FOREIGN PATENT DOCUMENTS

WO 2011134069 11/2011

OTHER PUBLICATIONS

International Search Report, PCT/CA2011/000495, Aug. 8, 2011.

*Primary Examiner* — Wei Wang
(74) *Attorney, Agent, or Firm* — Locke, Lord LLP

(57) ABSTRACT

An apparatus and method is provided for fracturing a well in a hydrocarbon bearing formation. The apparatus can include a valve subassembly that is assembled with sections of casing pipe to form a well casing for the well. The valve subassembly includes a sliding piston that is pinned in place to seal off ports that provide communication between the interior of the well casing and a production zone of the formation. A dart can be inserted into the well casing and propelled by pressurized fracturing fluid until the dart reaches the valve subassembly to plug off the well casing below the valve subassembly. The force of the fracturing fluid against the dart forces the piston downwards to shear off the pins and open the ports. The fracturing fluid can then exit the ports to fracture the production zone of the formation.

7 Claims, 12 Drawing Sheets

(56) References Cited

U.S. PATENT DOCUMENTS

2011/0240311 A1* 10/2011 Robison ..... E21B 23/04
166/373

* cited by examiner

APPARATUS AND METHOD FOR FRACTURING A WELL

PRIORITY

This application claims priority of U.S. Provisional Patent Application No. 61/328,770 filed Apr. 28, 2010 and U.S. Provisional Patent Application No. 61/376,364 filed Aug. 24, 2010 and hereby incorporates the same provisional applications by reference herein in their entirety.

TECHNICAL FIELD

The present disclosure is related to the field of apparatuses and methods for fracturing a well in a hydrocarbon bearing formation, in particular, down-hole valve subassemblies that can be opened to fracture production zones in a well.

BACKGROUND

It is known to use valve subassemblies placed in well casing that can be opened once the well casing has been cemented into place. These valve subassemblies or "subs" can use a ball valve seat mechanism that can receive a ball placed into the casing. Once the ball is seated in the valve seat, flow through the valve sub is cut off. The pressure of fracturing fluid injected into the casing will cause the closed valve seat mechanism to slide a piston forward in the valve sub thereby opening ports in the wall of the valve sub to allow the pressure of the fracturing fluid penetrate into a production zone of a hydrocarbon bearing formation. The ball valve seat mechanism can be comprised of varying sized openings. Typically, a number of the valve subs are placed in series in the casing at predetermined intervals in spacing along the well into the formation. The largest diameter valve seat is placed nearest the top of the well with progressively smaller diameter valve seats with each successive valve sub place in the casing string. In this manner, the further valve sub, the one having the smallest diameter opening can be closed by placing the matching sized ball into the casing, which can pass through all of the preceding valve subs, each having larger diameters than the valve sub being closed, until the ball reaches its matching valve sub.

One shortcoming of these known ball valve seat mechanisms is that they cannot be cemented into place with a casing string, as there is no way to clean or wipe the cement out of the valve seat mechanisms. These mechanisms have to be run on a liner with open hole packers in a well bore, which is more costly to carry out.

Another shortcoming is that the volume of fluid, and the rate of fluid flow, is constricted by the progressively decreasing diameter of the ball valve seat mechanism disposed in each of the valve subs, which becomes increasingly restricted with each successive valve sub in the well. While the number of these valve subs can be as high as 23 stages, put in place with a packer system, the flow-rate that can be obtained through these valve subs is not high, for example, a flow rate of 15 cubic meters per minute cannot be obtained through these valve subs.

It is, therefore, desirable to provide a fracturing valve sub that overcomes the shortcomings of the prior art.

SUMMARY

An apparatus and method for fracturing a well is provided. In one embodiment, the apparatus comprises a valve subassembly that is further comprised of a tubular valve body having upper and lower ends, the valve body comprising at least one port extending through a sidewall thereof nearer the upper end. In some embodiments, the cross-sectional area of the port or ports can be equal to the cross-sectional area of valve body inside diameter. In so doing, the apparatus can allow produced fluids to enter into the apparatus at or near the same rate of flow that the fluids can pass through the apparatus. The apparatus can further comprise a tubular piston slidably disposed within the valve body. The piston can move from a closed position where the at least port is closed to an open position where the at least one port is open. The apparatus can further comprise one or more shear pins disposed between the piston and the valve body to hold the piston in the closed position. When sufficient force is placed on the piston, the shear pins can shear away to allow the piston to move from the closed position to the open position.

The apparatus can also comprise a tubular sleeve disposed within the piston. The sleeve or the piston can comprise grooves disposed on an interior side wall thereof extending from an upper end to a lower end thereof. The grooves can be configured to receive a dart configured to engage the sleeve or the piston so as to close off the passageway extending through the apparatus and to apply downward force against the sleeve that, in turn, places the downward force on the piston to move from the closed to open position.

In operation, an apparatus can be placed in a casing string near a production zone in a well. In other embodiments, a plurality of the apparatuses can be placed at predetermined locations along the casing string to enable the fracturing of the well at a plurality of production zones disposed therein. The grooves disposed on the sleeve or the piston can be configured to allow keys disposed on a dart to either pass through the sleeve or piston, or to engage the sleeve or piston so at to open that particular apparatus. When a plurality of apparatuses are used in casing string, the apparatus nearest the top of the well can comprise sleeve grooves that are wider than the sleeve grooves of the next apparatus placed further down the casing string. Accordingly, each successive apparatus can comprise sleeve grooves narrower than the preceding apparatus. Therefore, the apparatus at the end of the casing string will have the narrowest sleeve grooves of all the apparatuses disposed in the casing string. Thus, when the dart for the last apparatus, that is, the dart with the narrowest keys, is inserted into the casing string and moved along by the pressurized fracturing fluid injected into the well following the dart, the keys of that dart can pass through the sleeve grooves of each apparatus that precedes the last apparatus. When this dart reaches the last apparatus, the dart keys can engage the sleeve grooves and hold the dart in place. The pressurized fracturing fluid contacts dart cups disposed on an upper end of the dart to apply downward force on the cups to engage the sleeve to thereby move the piston to the open position. Once the piston is in the open position, the pressurized fracturing fluid can pass through the valve port(s), breaking the casing cement to provide a path to the formation and then fracture the formation so as to allow produced fluids enter into the casing string through valve ports. As the dart keys can provide means to simply hold the dart in place against its corresponding sleeve until the pressurized fracturing fluid can contact the dart cups and, hence, the sleeve and piston, finer graduations in dart key width and corresponding sleeve groove width can be implemented. In so doing, the inventor believes that the number of apparatuses used in a single casing string can be in the range of 16 to 30 or more. In addition to this, the sleeve of each apparatus can have the same inside diameter from the first apparatus to the last apparatus in the casing string to thereby enable the same volume and flow rate of produced fluids through each apparatus as opposed to prior art devices.

In some embodiments, each apparatus can comprise a corresponding dart with keys configured to only engage the sleeve or piston grooves of that apparatus. The grooves of the apparatus can be configured into particular profiles that will only match a corresponding profile on a matching dart. As such, a dart can pass through an apparatus where the profile do not match. Matching profiles will allow the dart to lock into the grooves and the pressurized fracturing fluid contacts dart cup disposed on an upper end of the dart to apply downward force on the cup to engage the piston to thereby move the piston to the open position.

Broadly stated, in some embodiments, an apparatus is provided for fracturing a well, comprising: a tubular valve body comprising upper and lower ends defining communication therebetween, the valve body further comprising at least one port extending through a sidewall thereof nearer the upper end; a tubular piston slidably disposed in the valve body and configured to provide communication therethrough, the piston closing the at least one port in a closed position, the piston opening the at least one port in an open position; means for moving the piston from the closed position to the open position when a downward force is placed on the piston; and a tubular end cap disposed on the lower end of the valve body, the end cap configured to stop the piston when the piston moves from the closed position to the open position.

Broadly stated, in some embodiments, the apparatus further comprises a dart comprising a longitudinal shaft comprising upper and lower ends, the lower end comprising a key, the key configured to engage the grooves disposed in the moving means, the upper end comprising at least one dart cup configured to seal off communication through the piston when the key has engaged the grooves.

In some embodiments, a method is provided for fracturing a well in a formation, the method comprising the steps of: providing a valve sub apparatus and placing the apparatus in a casing string disposed in the well, the apparatus located near a production zone in the formation; placing a dart into the casing string; and injecting pressurized fracturing fluid into the casing string wherein the fracturing fluid moves the dart through the casing string into the apparatus until the keys of the dart engage the sleeve to place a downward force on the sleeve to move the piston from the closed position to the open position wherein the fracturing fluid can pass through the at least one port of the apparatus to fracture the formation.

Broadly stated, in some embodiments, a system of darts and keys for use downhole in a well is provided, the system comprising: at least one apparatus, the apparatus comprising: a tubular valve body comprising upper and lower ends defining communication therebetween, the valve body further comprising at least one port extending through a sidewall thereof nearer the upper end; a tubular piston slidably disposed in the valve body and configured to provide communication therethrough, the piston closing the at least one port in a closed position, the piston opening the at least one port in an open position; means for moving the piston from the closed position to the open position when a downward force is placed on the piston; a tubular end cap disposed on the lower end of the valve body, the end cap configured to stop the piston when the piston moves from the closed position to the open position; and at least one dart comprising a longitudinal shaft comprising upper and lower ends, the lower end comprising a key, the key configured to engage the grooves disposed in the moving means, the upper end comprising at least one dart cup configured to seal off communication through the piston when the key has engaged the grooves, where the dart key is configured to specifically engage the moving means of a particular apparatus and the key can be targeted to the particular apparatus.

DETAILED DESCRIPTION OF EMBODIMENTS

Figure 1:
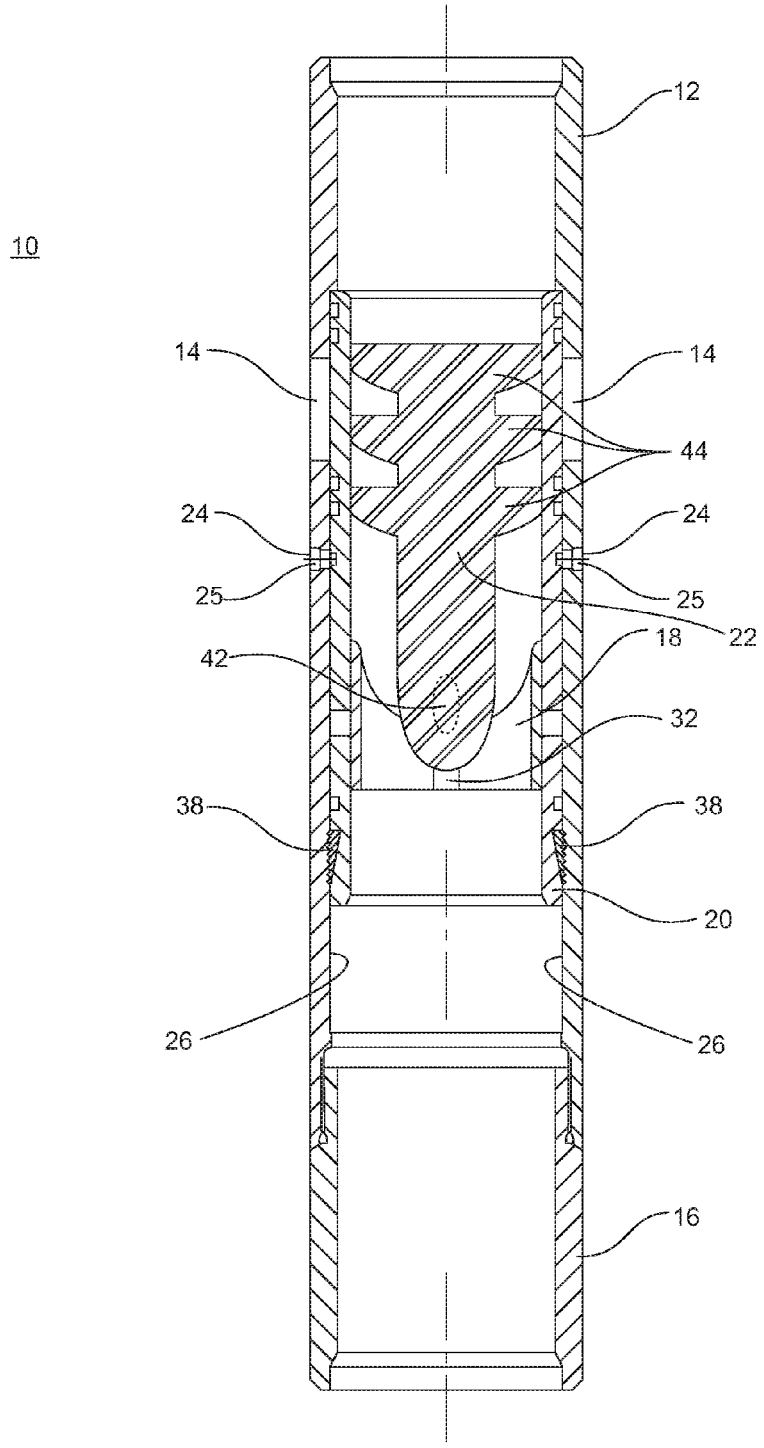
FIG. 1 is a side cross-sectional elevation view depicting a fracturing valve subassembly.

Referring to FIGS. 1 to 6, an embodiment of fracturing valve sub 10 is shown. The major components of valve sub 10 comprise valve body 12, end cap 16 disposed on a lower end of body 12, tubular piston 20 slidably disposed within body 12 and tubular sleeve disposed within piston 20. When assembled, piston 20 is held position within body 12 by shear pins 25 disposed in holes 24. Each valve sub 10 can further comprise a dart 22 that corresponds to a particular valve sub 10.

Figure 2:
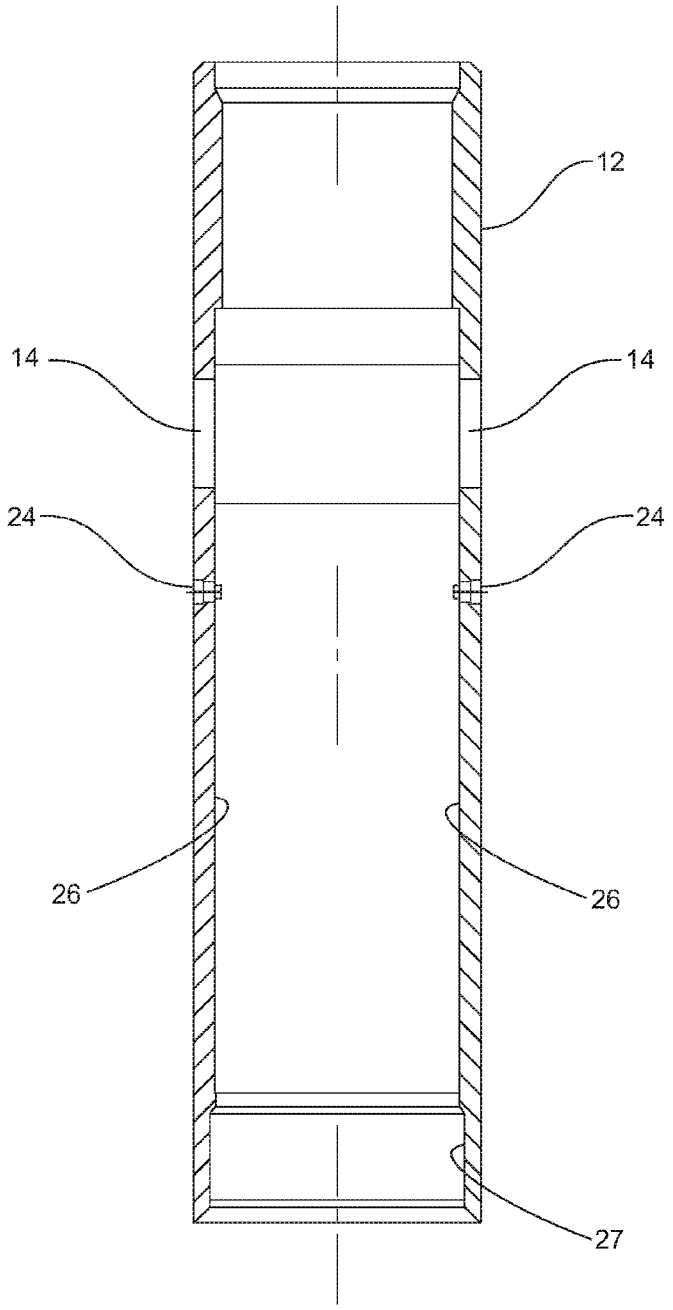
FIG. 2 is a side cross-sectional elevation view depicting the body of the valve subassembly of FIG. 1.

Referring to FIG. 2, one embodiment of valve body 12 is shown in more detail. In the illustrated embodiment, body 12 can comprise ports 14 extending through the sidewall of body 12 nearer the upper end thereof. Ports 14 provide a means for pressurized fracturing fluid to pass through and fracture a production zone of a formation. In a representative embodiment, the total cross-sectional area of ports 14 can be approximately equal to the cross-sectional area of the inside diameter of valve sub 10 itself such that there is little or no flow restriction of fluids passing through ports 14 in or out of valve sub 10. In one embodiment, body 12 can comprises holes 24 disposed below ports 14 for receiving shear pin 25, as shown in FIG. 1. In another embodiment, body 12 can comprise ratchet threads 26 disposed on the interior surface thereof. In a further embodiment, body 12 can comprise threads 27 disposed at a lower thereof for releasably coupling to end cap 16, as shown in FIG. 1.

Figure 3:
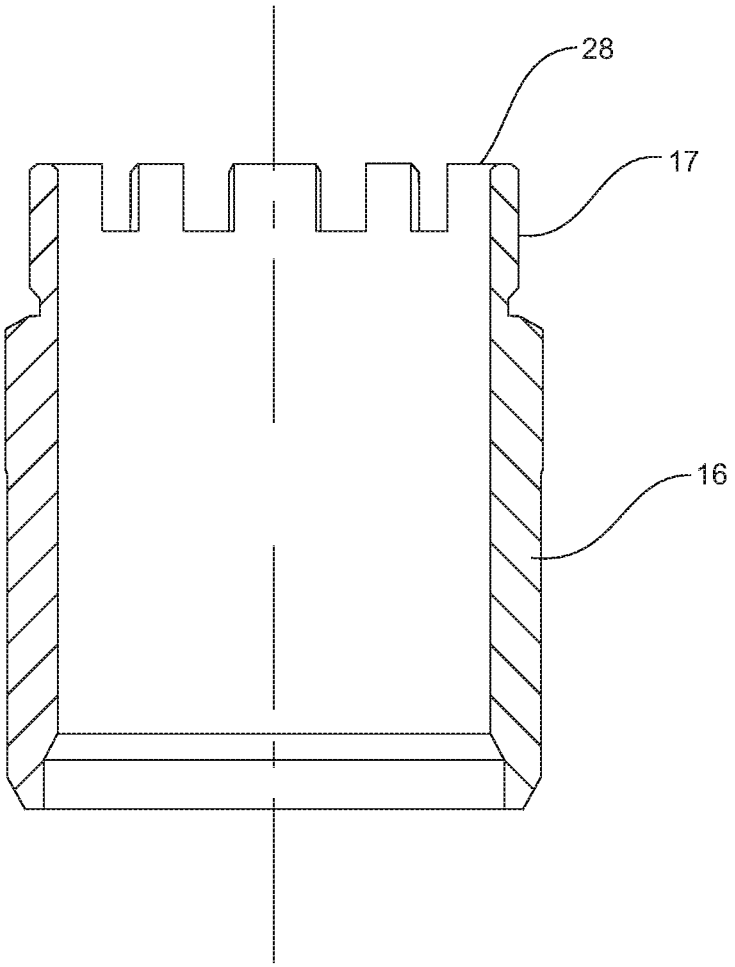
FIG. 3 is a side cross-sectional elevation view depicting the end cap of the valve subassembly of FIG. 1.

Referring to FIG. 3, one embodiment of end cap 16 is shown in more detail. End cap 16 can comprise threads 17 disposed on an upper end therefor for releasably coupling with threads 27 disposed on body 12. In another embodiment, end cap 16 can comprise cogs 28 disposed on its upper end for engaging with piston 20, as described in more detail below.

Figure 4:
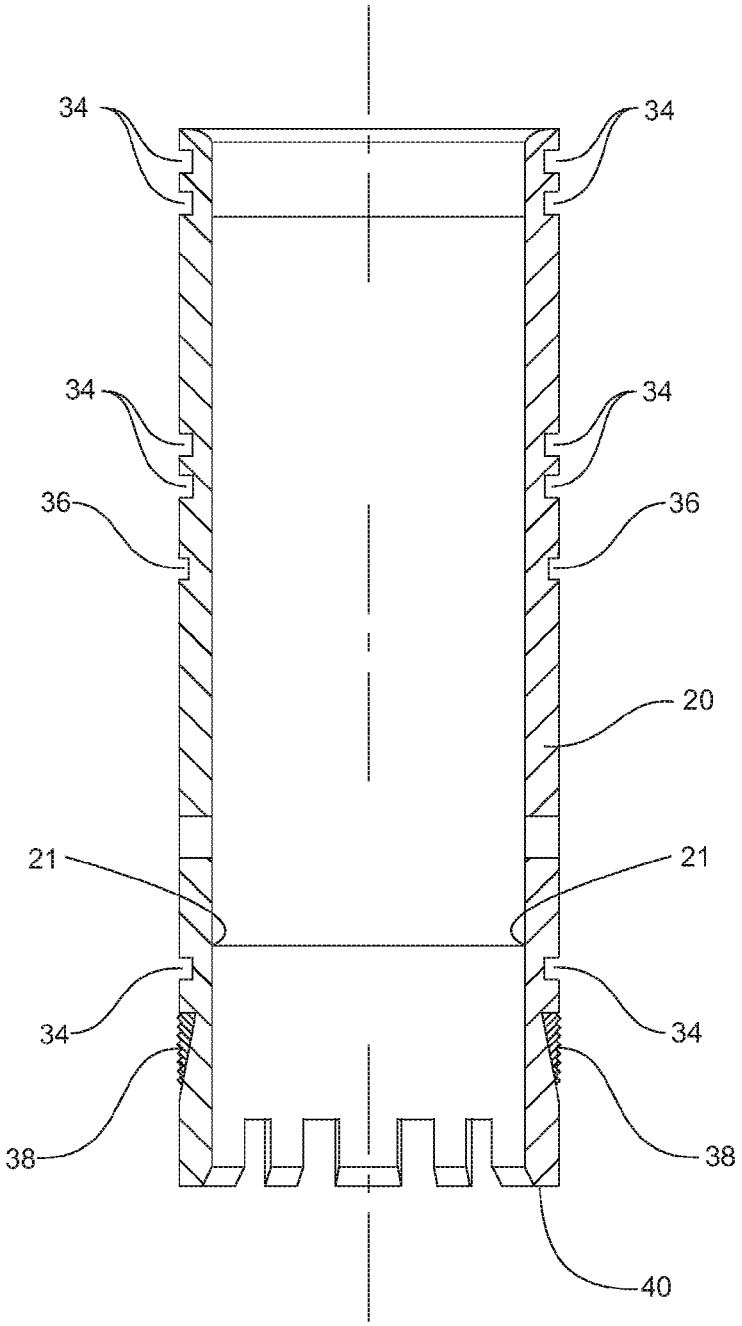
FIG. 4 is a side cross-sectional elevation view depicting the piston of the valve subassembly of FIG. 1.

Referring to FIG. 4, one embodiment of piston 20 is shown in more detail. As shown, piston 20 can comprise a tubular member further comprising one or more seal grooves 34 disposed along the length of piston 20, the grooves extending circumferentially around piston 20. Seal grooves 34 can be configured to receive o-rings or any other suitable sealing member as well known to those skilled in the art. In the illustrated embodiment, two seal grooves 34 are disposed at an upper end of piston 20 whereas another pair of seal grooves 34 can be disposed nearer the middle of piston and a single seal groove 34 disposed near the lower end of piston 20. In one embodiment, piston 20 can comprise shoulder 21 disposed on the interior surface thereof for retaining sleeve 18 in position, as shown in FIG. 1. Piston 20 can further comprise holes 36 disposed on the exterior surface thereof to receive shear pins 25, as shown in FIG. 1. In another embodiment, piston 20 can comprise ratchet ring 38 disposed around the lower end thereof, which is configured to engage ratchet threads 26 disposed on the interior surface of body 12. In a further embodiment, piston 20 can comprise cogs 40 disposed on the lower end thereof, cogs 40 being configured to engage cogs 28 on end cap 16.

Figure 5:
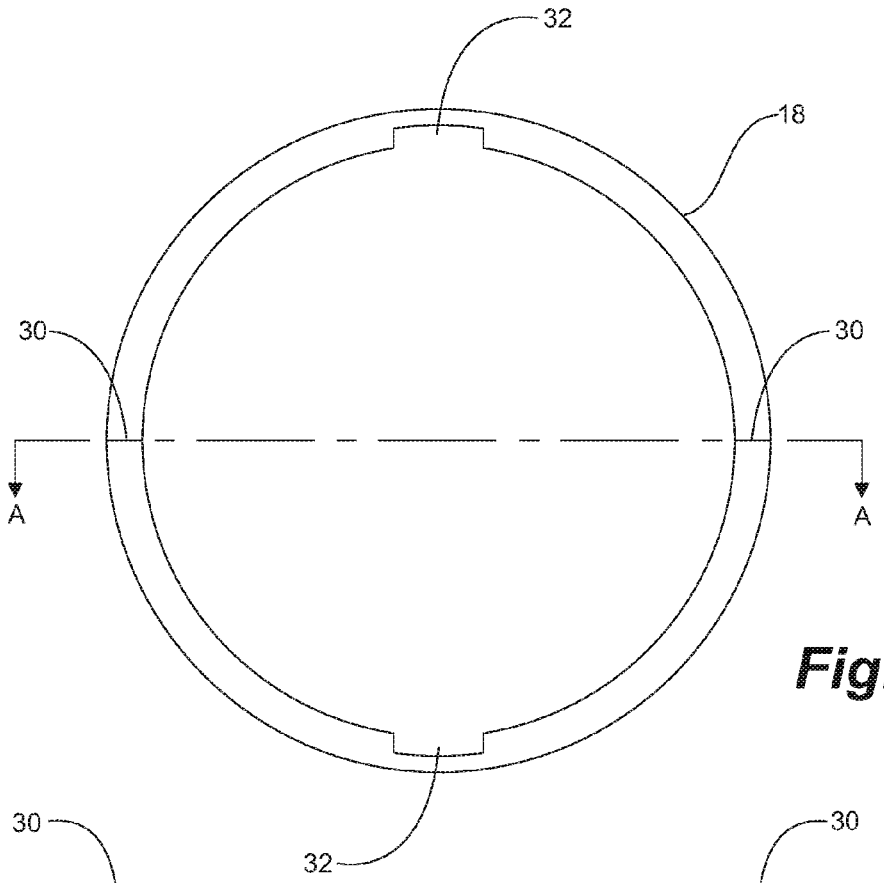
FIG. 5 is a top plan view depicting the sleeve of the valve subassembly of FIG. 1.
Figure 6:
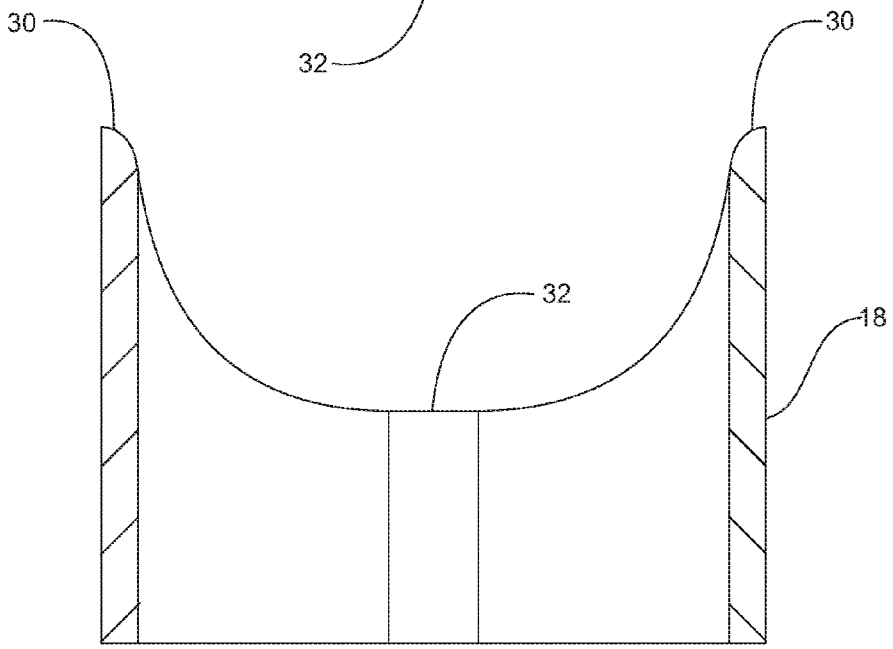
FIG. 6 is a side cross-sectional elevation view along section lines A-A depicting the sleeve of FIG. 5.

Referring to FIGS. 5 and 6, an embodiment of sleeve 18 is shown. In this embodiment, sleeve 18 can be comprised of a tubular member comprising peaks 30 disposed on one end thereof, and keyways 32 extending therethrough on an interior surface thereof. As shown in FIG. 1, sleeve 18 is disposed within piston 20 sitting on shoulder 21.

Figure 7:
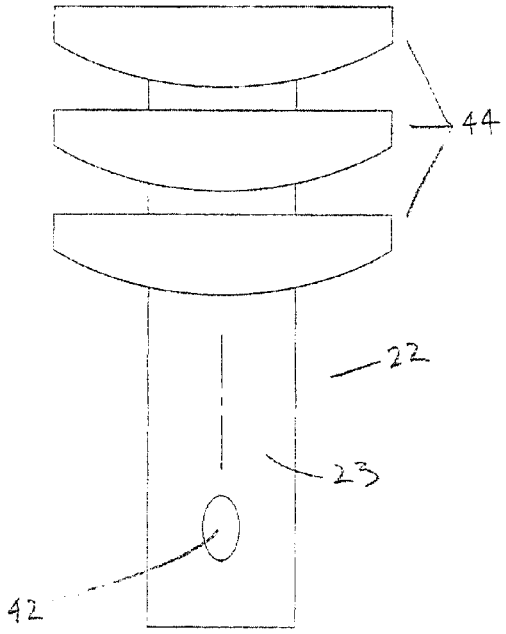
FIG. 7 is a side elevation view depicting the dart of the valve subassembly of FIG. 1.
Figure 8:
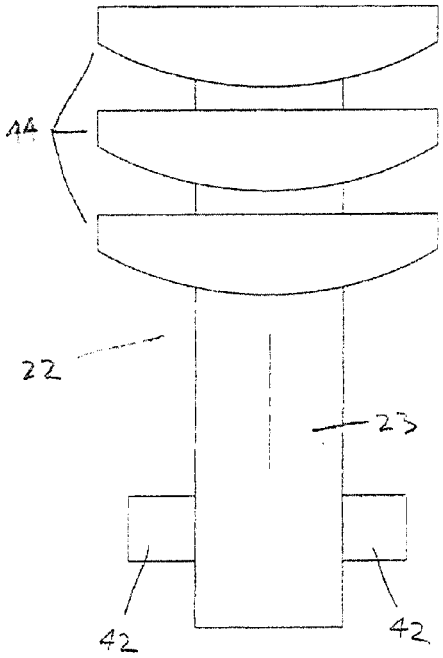
FIG. 8 is a front elevation view depicting an embodiment of the dart of FIG. 7.
Figure 9:
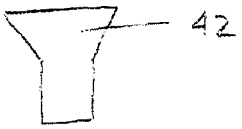
FIG. 9 is a front elevation view depicting an alternate embodiment of the key of the dart of FIG. 7.

Referring to FIGS. 7 and 8, an embodiment of dart 22 is shown. Dart 22 can comprise of shaft 23, one or more dart cups 44 disposed on the upper end thereof and one or more keys 42 disposed nearer the lower end thereof, keys extending substantially perpendicular to shaft 23. Dart cups 44 can be circular in configuration, when viewed from the top, or of any other configuration such that darts cups 44 can substantially contact the interior surface of piston 20 when pressurized fracturing fluid is injected into the well. In this embodiment, keys 42 can comprise an oval cross-sectional shape. In another embodiment, keys 42 can comprise a keystone shape, as shown in FIG. 9. In some embodiments, dart 22 can be comprised of rubber, metal, a combination of rubber and material or any other suitable material, or other combinations thereof, as well known to those skilled in the art.

Figure 10:
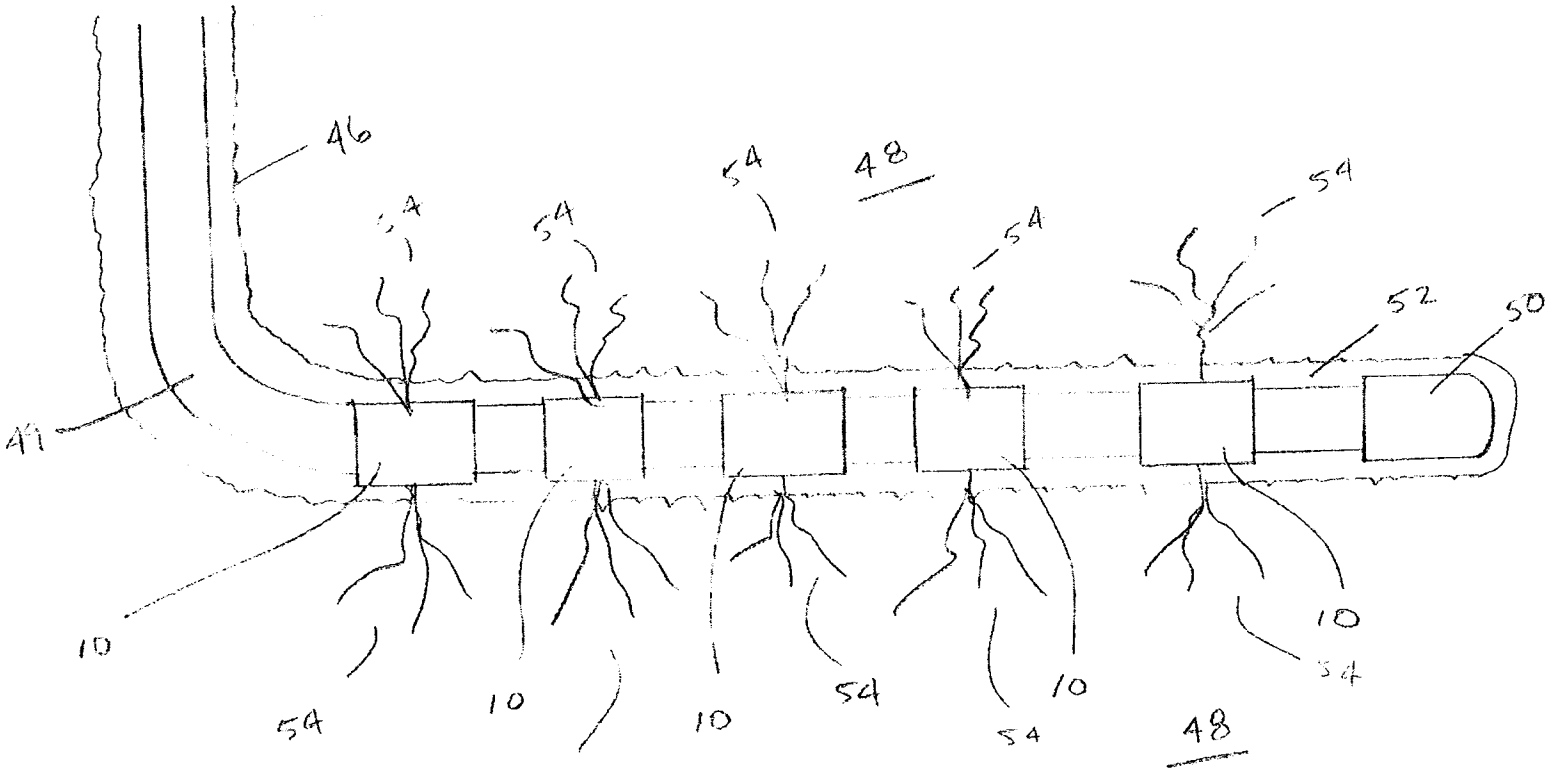
FIG. 10 is a side cross-sectional view depicting a well in a formation with a plurality of the valve subassemblies of FIG. 1.

Referring to FIG. 10, a cross-sectional view of a horizontal well comprising the apparatus described herein is shown. In this example, well 46 in formation 48 comprises well casing 49 comprising a plurality of valve subs 10 displaced along well 46. In installing liner 49, float shoe 50 can be run into well 46 where float shoe 50 comprises a float collar, a cement stage collar with a latching wiper plug and a hydraulic burst sub, as well known to those skilled in the art, followed by a section of casing, then followed by a valve sub 10. This is then followed by another section of casing and another valve sub 10, and so on. The number of valve subs 10 and the spacing between the valve subs to be determined by the size of formation 48 and the number of production zones 54 contained in formation 48. Once well casing 49 is in place in well 46, well casing 49 can be cemented in place. A wiper dart can then be pumped into well casing 49 with flush cleaning fluid to clean all valve subs 10 and keyways 32 contained in each valve sub 10.

After well casing 49 has been set in well 46 and pressure tested, well casing 49 is then ready for stimulation. In other embodiments, the apparatuses and methods described herein can also be used with conventional open-hole packers and liner packers.

To stimulate well casing 49, pressurized fracturing fluid can be injected into well casing 49 until the pressure of the fluid in well casing 49 reaches the burst pressure of the burst sub. Once the burst sub opens, the dart 22 for the valve sub 10 located at the end of well casing 49 can be inserted into well casing 49. As described above, each valve sub 10 has a corresponding dart 22, wherein the keys 42 of a particular dart 22 will only engage the keyways 32 of its corresponding valve sub 10. The keys 42 of the valve sub 10 at the end of well 46 being the narrowest, with the keys 42 becoming progressively wider with each successive valve sub 10 disposed in well casing 49 towards the top of well 46.

When the first dart 22 is pumped into well casing 49 with the pressurized fracturing fluid, the dart will encounter the first valve sub 10 with the keys 42 of the dart contacting sleeve 18 of that valve sub. Peaks 30 on the sleeve serve to turn keys 42 either clockwise or counterclockwise thereby guiding keys 42 through keyways 32. As keyways 32 of each valve sub 10 are wider than the keyways of the valve sub 10 located at the end of well 46, keys 42 of the first dart 22 will pass through the first valve sub 10 and each successive valve sub 10 until the first dart 22 reaches the last valve sub 10 where keys 42 land into and engage the keyways 32 of the last valve sub 10. In so doing, the pressurized fracturing fluid causes the dart cups 44 to seat in piston 20 of valve sub 10 and cause a high-pressure seal. As noted above, dart cups 44 can comprise a circular shape to seal against piston 20. In other embodiments, dart cups 44 can comprise any other shape that are configured to function equivalently to seal against piston 20.

Once dart cups 44 are sealed against piston 20, the hydraulic force of the pressurized fracturing fluid applies a downward force on piston 20 until the force exceed the shear force rating of shear pins 25 such that shear pins 25 shear thereby allowing piston 20 slide downwards from a closed position, where ports 14 are sealed off, to an open position where ports 14 are revealed. As piston 20 moves to the open position, ratchet ring 38 can engage ratchet threads 26 to lock piston 20 in place and to prevent piston 20 from sliding upwards to the closed position. In another embodiment, cogs 40 disposed on piston 20 can engage cogs 28 disposed on end cap 16 to prevent piston 20 from rotating within body 12 once in the open position.

Once dart 22 is in place in piston 20, dart 22 plugs well casing 49 below valve sub 10 thereby directing fluid to flow through ports 14 to fracture cement casing 52 and production zone 54 in formation 48. As all valve subs 10 have the same inside diameter, there is no restriction of flow throughout well casing 49. Because the valve subs have the same inside diameter throughout the casing string, the valve subs 10 can be used on liners with open hole packers or it can be incorporated into a casing string that can be cemented into a well bore, as well known to those skilled in the art, unlike the prior art devices that can only be used on liners with open hole packers. Accordingly, using the valve subs 10 on a casing string that can be cemented in place can reduce the cost of producing substances from the well. In addition, because the valve subs 10 all have the same inside diameter, this can allow a fracturing operator to pump fluid and sand down well casing 49 at higher rates (for example, 15 cubic meters per minute) without any friction pressure or pressure drops that would otherwise exist using prior art devices due to restrictions arising from the narrow internal diameters of the prior art devices. After the first dart 22 has been placed to fracture the first production zone 54, the dart 22 for the next valve sub 10 along well casing 49 can be placed to fracture the next production zone 54. This process can be then be repeated for each successive valve sub 10 along well casing 49. Fracturing at high fluid rates can now be a continuous process by pumping a dart to open each valve, which can dramatically reduce the fracturing time for each interval, that is, for each valve sub 10.

Once the fracturing program for well 46 has been completed, coil tubing or conventional tubing can be run into well casing 49 with a mud motor and mill. An operator can then circulate fluid to the first valve sub 10 and set 1000 daN of string weight, as an example, so that the mill can grind up the dart 22 in the valve sub. In so doing, the operator will notice rubber and metal cuttings at a flow back tank based on the calculated fluid volumes per the depth of each valve sub 10. After a few minutes, the mill will cut the dart and its keys into tiny pieces and move through the valve sub. The operator can then pull the mill up back through the valve sub, and then run back through the valve sub to ensure full drift inner diameter. The operator can then continue on to the next valve sub 10 and dart 22. This process can be repeated until all darts 22 have been drilled out of the valve subs 10. The operator can then pull the mill to the surface and well 46 will be ready for production.

Figure 11:
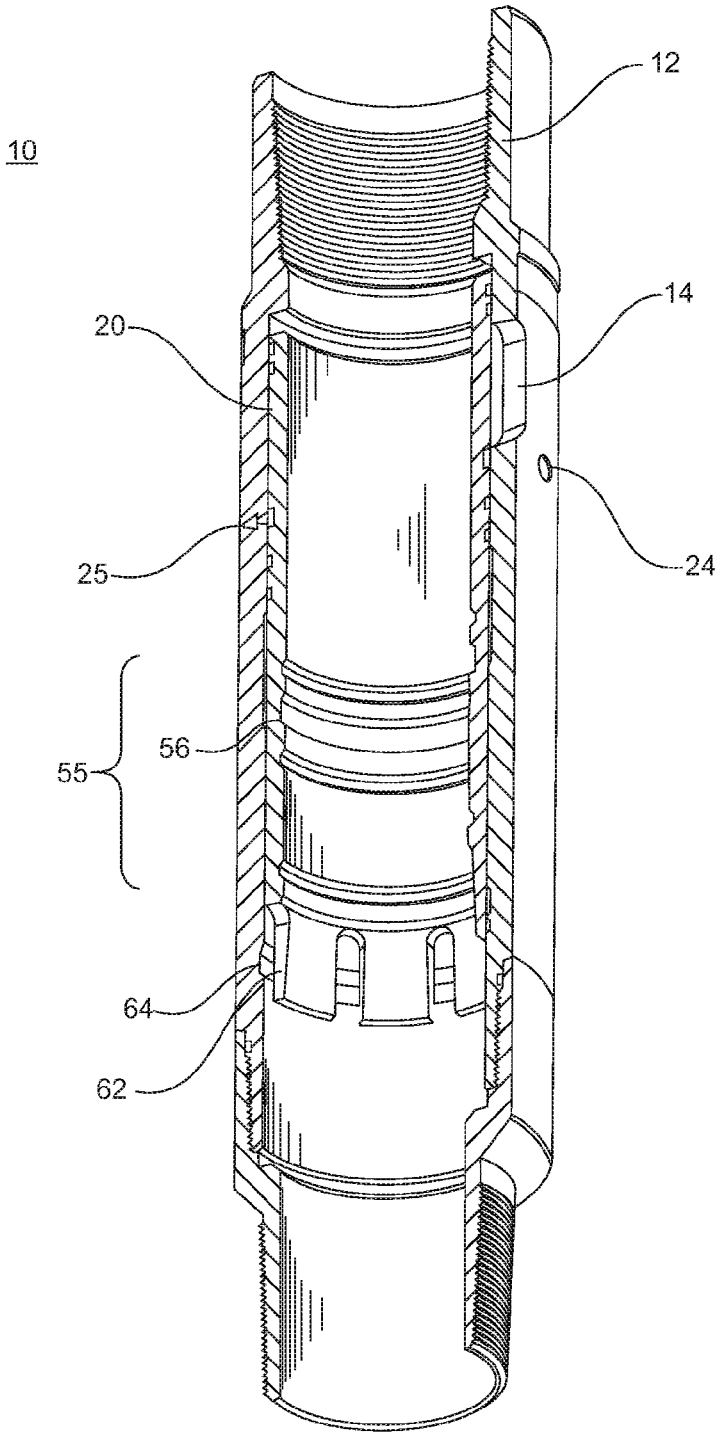
FIG. 11 is a perspective cut-away view depicting a further embodiment of a fracturing valve subassembly in a closed position.
Figure 12A:
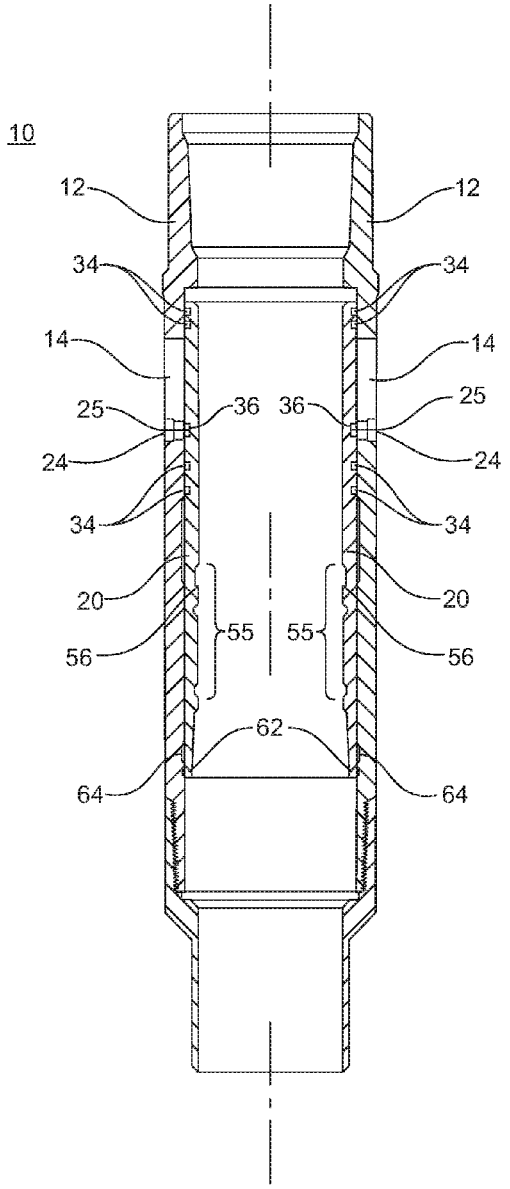
FIG. 12A is a side cross-sectional elevation view depicting the fracturing valve subassembly of FIG. 11 in a closed position.
Figure 12B:
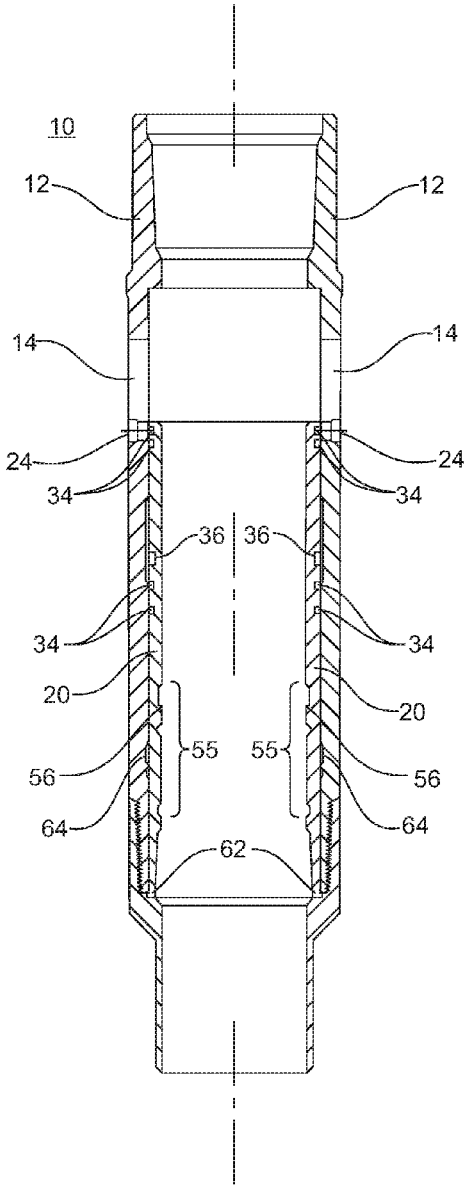
FIG. 12B is a side cross-sectional elevation view depicting the fracturing valve subassembly of FIG. 11 in an open position.

Referring to FIG. 11, in some embodiments, fracture valve sub 10 can comprise a valve body 12 and piston 20 without sleeve 18. In some embodiments, circumferential grooves disposed along the inner wall of piston 20 can comprise key profile 55. Key profile 55 can further comprise locking shoulder 56. FIG. 12A shows an embodiment of fracture valve sub 10 in a closed position. FIG. 12B shows an embodiment of fracture valve sub 10 in an open position.

Figure 13:
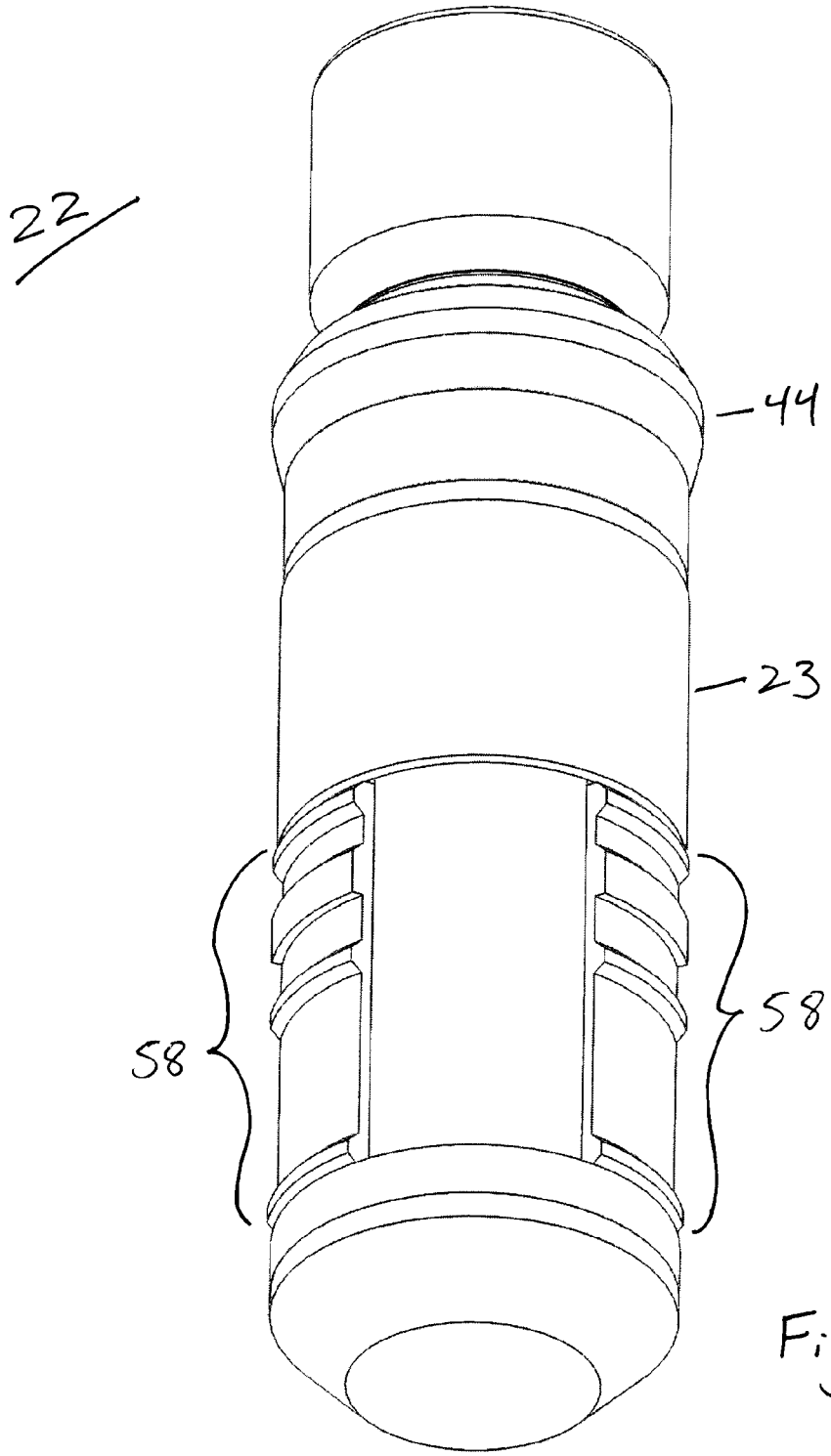
FIG. 13 is a perspective view depicting an embodiment of the dart of the valve subassembly of FIG. 11.

Referring to FIG. 13, an embodiment of dart 22 with a dart profile 58 is shown. In some embodiments, more than one dart profile 58 can be disposed around the exterior circumference of dart 22.

Figure 14:
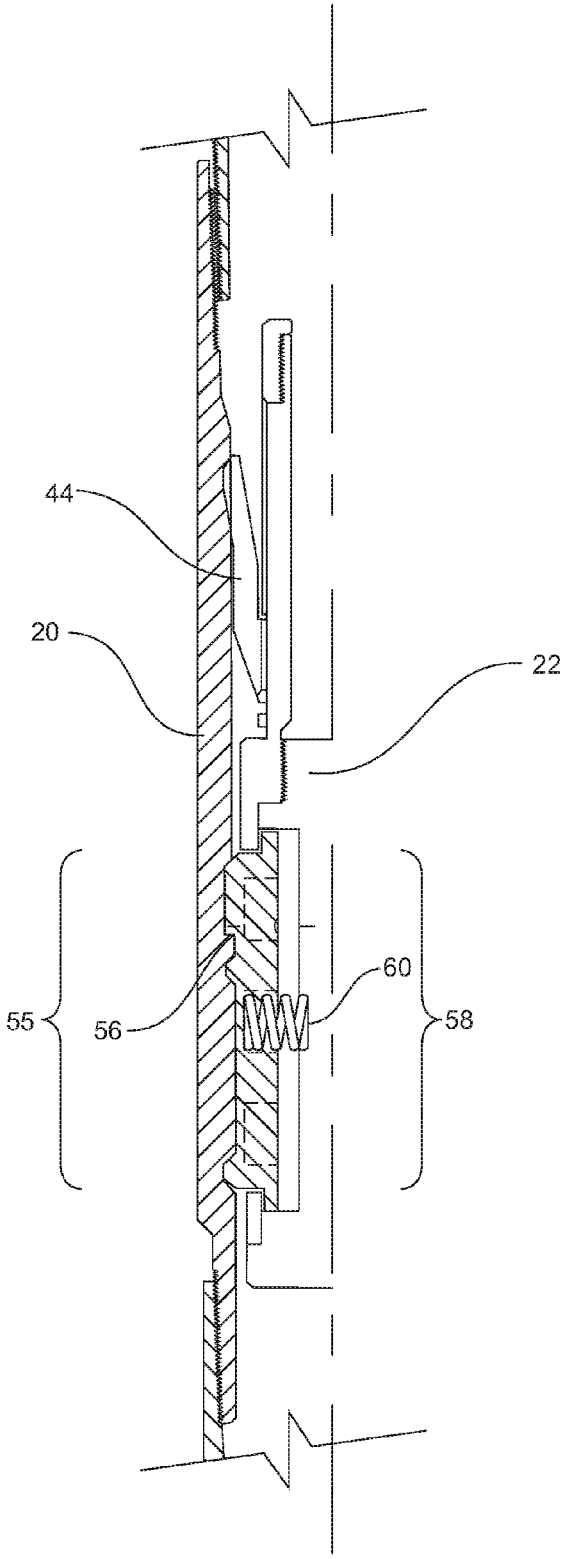
FIG. 14 is a close-up side cross-sectional elevation view depicting the fracturing valve subassembly of FIG. 12A and a dart.
Figure 15A:
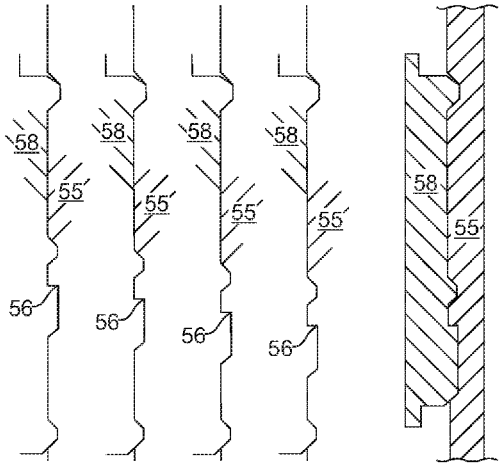
FIGS. 15A-15D are close-up side cross-sectional elevation view depicting possible embodiments of key profiles for the fracturing valve subassembly of FIG. 12A and the corresponding key profiles of the darts.
Figure 15B:
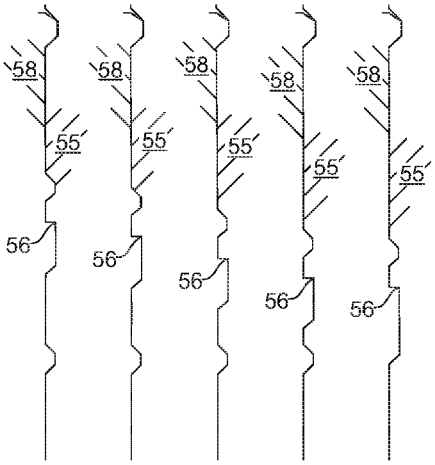
Figure 15C:
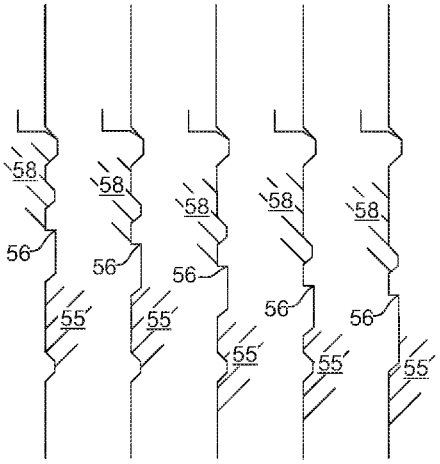
Figure 15D:
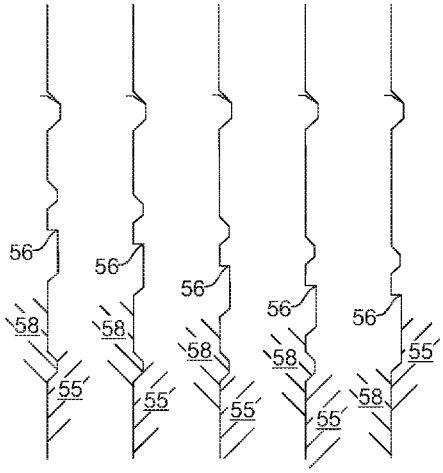

Referring to FIG. 14, in some embodiments, key profile can be mirrored by dart profile 58 on dart 22. In some embodiments, dart 22 can comprise biasing means to bias dart profile 58 towards the inner wall of piston 20 to engage key profile 55 and lock on locking shoulder 56 when dart profile 58 matches key profile 55. In some embodiments, biasing means can comprise spring 60, although it would be understood and appreciated by a person skilled in the art that any biasing means performing the same equivalent function can be used in place of, or in combination with, spring 60.

Referring to FIGS. 15A, 15B, 15C, 15D, some embodiments of possible key profile 55 and dart profile 58 configurations are shown. It would be apparent to one skilled in the art that any shape or pattern of key or dart profile that can interlock and perform the same function can be used. It is contemplated by the inventor, and would be apparent to one skilled in the art, that this system of key and dart profiles can have a wide range of application. For example, the system can be used for pump-down bridge plugs for isolating intervals, or multiple acidizing tools or plugs.

In operation of the embodiments of fracture valve 10 depicted in FIGS. 11-15, a dart 22 can travel through casing 49 until it reaches a matching key profile 55, and can latch into piston 20, locking at shoulder 56. The top of dart cup 44 on dart 22 can form a seal within valve body 12. As noted above, dart cups 44 can comprise a circular shape to seal against piston 20. In other embodiments, dart cups 44 can comprise any other shape that are configured to function equivalently to seal against piston 20. This seal can create a hydraulic pressure on locked dart 22 and piston 20. With a seal formed, shear pins 25 can shear under the pressure and piston 20 will be allowed to travel with the dart 22 into an open position, for example, as shown FIG. 12B. As piston 20 travels down well, it can either ratchet with a ring and a ratchet thread to remain in an open position as described above, or it can latch with a set of latching fingers 62 into the open position. Once fracture valve sub 10 is in an open position, ports 14 can be open to allow fracturing fluid to be released. This system can allow for a full fracturing diameter to the well surface during the fracturing operation.

As described above, each valve sub 10 can have a corresponding dart 22. The dart profile 58 of a particular dart 22 will only engage the key profile 55 of its corresponding valve sub 10. As depicted in FIGS. 10, 15A, 15B, 15C, and 15D, sets of fracture valve subs 10 and sets of darts 22 can be used where key profile 55 and dart profile 58 are varied such that shoulder 56 is located in different positions in each key profile 55.

When the first dart 22 is pumped into well casing 49 with the pressurized fracturing fluid, the dart can encounter the first valve sub 10 with dart profile 58 contacting key profile 55. If the profiles do not match, the dart 22 will not lock and it will progress down well until it meet a valve sub 10 with a key profile 55 that is complimentary to the dart profile 58 of that particular dart 22.

After the first dart 22 has opened first valve sub 10 to fracture the first production zone 54, the dart 22 for the next valve sub 10 along well casing 49 can be placed to fracture the next production zone 54. This process can be then be repeated for each successive valve sub 10 along well casing 49. Fracturing at high fluid rates can now be a continuous process by pumping a dart to open each valve, which can dramatically reduce the fracturing time for each interval, that is, for each valve sub 10.

In some embodiments, once the fracturing program for well 46 has been completed, conventional removal tools, as well known to those skilled in the art, can then be inserted in the tubing string to retrieve any darts. Darts 22 can be retrieved individually, in groups, or all at once. In some embodiments, dart 22 can comprise a latch (not shown) disposed at its lower end so that it can contact and connect with a further downstream dart. Latched darts can then be pulled to surface together. In some embodiments, dart 22 can comprise bypass outlets disposed on shaft 23 to assist in breaking any seal that was created by cup 44 and facilitate the removal of dart 22. The removal of the darts 22 can then allow for a full drift inner diameter of the well. In some embodiments, removed darts 22 can be reused to open closed valve subs 10.

Following the removal of dart 22, an operator can then shift valves 10 to a closed position and well 46 can be ready for production. Fracture valve sub 10 can be allowed to shift closed with a conventional shifting tool, as well known to those skilled in the art, after dart 22 has been removed. The shifting tool can allow for a locking of the piston 20 in a closed position in the absence of the shear pin. In some embodiments, fingers 62 can engage profile gap 64 on interior of valve body 12 in order to relock shifted piston 20 into a closed position, so that valve 10 may be reused.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A method for fracturing a well in a formation, the method comprising the steps of:

a) providing an apparatus having at least two valves, each valve having a key profile disposed thereon, wherein the key profile of each of the at least two valves is different from the key profile of the other of the at least two valves and a piston that is slidable between an open position and a closed position;

b) placing the apparatus in a casing string disposed in the well, the apparatus located near a production zone in the formation;

c) placing a dart into the casing string, the dart having a dart profile disposed thereon, wherein the dart profile matches the key profile on only one of the at least two valves; and d) injecting pressurized fracturing fluid into the casing string wherein the fracturing fluid moves the dart through the casing string into the apparatus until it reaches one of the at least two valves with the key profile which matches the dart profile and thereby engages the key profile disposed on an interior sidewall of a tubular piston disposed within the apparatus, to place a downward force on the piston to move the piston from the closed position to an the open position wherein the fracturing fluid can pass through at least one port of the apparatus to fracture the formation.

2. The method of claim 1, wherein the dart further comprises at least one dart cup uphole of the dart profile, configured to seal off communication through the piston when the dart profile has engaged the corresponding key profile.

3. The method of claim 1 comprising the additional step of removing the dart from the casing string.

4. The method of claim 3 wherein the dart is removed from the casing string by being drilled through.

5. The method of claim 3 wherein the dart is removed from the casing string by being retrieved.

6. The method of claim 1 comprising the additional step of shifting the piston back to the closed position.

7. A system of valves and at least one dart for use downhole in a well, the system comprising:

at least two valves, each valve comprising:

a) a tubular valve body comprising upper and lower ends defining communication therebetween, the valve body further comprising at least one port extending through a sidewall thereof nearer the upper end;

b) a tubular piston slidably disposed in the valve body and configured to provide communication therethrough, the piston closing the at least one port in a closed position, the piston opening the at least one port in an open position;

c) a key profile disposed on an interior sidewall of the piston and comprising at least two grooves and a locking shoulder, the key profile for moving the piston from the closed position to the open position when a downward force is placed on the piston; and d) a tubular end cap disposed on the lower end of the valve body, the end cap configured to stop the piston when the piston moves from the closed position to the open position;

where the key profiles of the at least two valves have the locking shoulders in different locations relative to the two grooves within their key profile, and the at least one dart comprising a longitudinal shaft comprising upper and lower ends, the lower end comprising a dart profile, the dart profile configured to engage grooves and locking shoulder of a matching key profile, the upper end comprising at least one dart cup configured to seal off communication through the piston when the dart profile has engaged the corresponding key profile, where the location of the two grooves and locking shoulder in the dart profile is configured to specifically bypass unmatching key profiles and specifically engage the key profile of a targeted valve.

* * * * *